US008720242B2

(12) United States Patent
Ogawa et al.

(10) Patent No.: US 8,720,242 B2
(45) Date of Patent: May 13, 2014

(54) ROLLING MILL FOR A PLATE OR A SHEET AND ITS CONTROL TECHNIQUE

(75) Inventors: Shigeru Ogawa, Tokyo (JP); Atsushi Ishii, Tokyo (JP); Yoji Nakamura, Tokyo (JP); Yasuhiro Higashida, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 733 days.

(21) Appl. No.: 12/734,439

(22) PCT Filed: Oct. 30, 2008

(86) PCT No.: PCT/JP2008/070251

§ 371 (c)(1), (2), (4) Date: Apr. 30, 2010

(87) PCT Pub. No.: WO2009/057820

PCT Pub. Date: May 7, 2009

(65) Prior Publication Data

US 2011/0041580 A1 Feb. 24, 2011

(30) Foreign Application Priority Data

Nov. 2, 2007 (JP) ..... 2007-286176
Oct. 8, 2008 (JP) ..... 2008-261408

(51) Int. Cl.
*B21B 37/00* (2006.01)

(52) U.S. Cl.
USPC ..... 72/10.2; 72/8.1; 72/10.3; 72/10.5; 72/199

(58) Field of Classification Search
USPC ..... 72/8.1, 10.2, 10.3, 10.5, 199
See application file for complete search history.

(56) References Cited

U.S. PATENT DOCUMENTS 3,733,866 A * 5/1973 Arimura et al. ..... 72/10.3
4,365,496 A * 12/1982 Shiozaki et al. ..... 72/249

(Continued)

FOREIGN PATENT DOCUMENTS

EP 0130551 * 1/1985
JP 54-46162 4/1979

(Continued)

OTHER PUBLICATIONS

International Search Report dated Jan. 20, 2009 issued in corresponding PCT Application No. PCT/JP2008/070251.

(Continued)

*Primary Examiner* — Dana Ross
*Assistant Examiner* — Onekki Jolly
(74) *Attorney, Agent, or Firm* — Kenyon & Kenyon LLP

(57) ABSTRACT

The present invention provides a rolling mill of a plate or a sheet which eliminates rolling trouble due to warping of the rolled material and wavy shaped flatness defects running through the plate or sheet width direction such as "waviness", "full waves, and "small waves" by providing a pair of a top and bottom work rolls, a pair of electric motors independently driving the pair of rolls, and control means for controlling one electric motor using the roll rotational speed as a control target value and controlling the other electric motor using the rolling torque applied to the rolled material from the work roll driven by that electric motor becoming substantially constant as a control target and using the drive torque as a control amount and a control technique of such a rolling mill of a plate or a sheet.

18 Claims, 9 Drawing Sheets

(56) References Cited

U.S. PATENT DOCUMENTS

| | | | | |
|---|---|---|---|---|
| 4,566,299 | A | 1/1986 | Koyama et al. | |
| 4,614,103 | A * | 9/1986 | Takagi et al. | 72/243.2 |
| 5,267,170 | A * | 11/1993 | Anbe | 700/154 |
| 6,057,870 | A * | 5/2000 | Monnier et al. | 347/171 |
| 7,086,260 | B2 * | 8/2006 | Abi-Karam | 72/10.2 |
| 7,325,489 | B2 | 2/2008 | Zeigler et al. | |
| 7,378,777 | B2 * | 5/2008 | Moteki et al. | 310/323.16 |
| 7,524,400 | B2 * | 4/2009 | Franz | 162/205 |
| 2003/0015010 | A1 * | 1/2003 | Kobayashi et al. | 72/8.9 |
| 2008/0004164 | A1 * | 1/2008 | Alsip | 482/93 |

FOREIGN PATENT DOCUMENTS

| | | |
|---|---|---|
| JP | 54-71064 | 6/1979 |
| JP | 55-73404 | 6/1980 |
| JP | 60-9509 | 1/1985 |
| JP | 60-9511 | 1/1985 |
| JP | 61-99511 | 5/1986 |
| JP | 07-164031 | 6/1995 |
| JP | 2002-346617 | 12/2002 |

OTHER PUBLICATIONS

Kasai, T., et al., "Variable-Speed Drive and Control Systems for Rolling Mills," *Fuji Electric Journal*, vol. 73 (11), pp. 614-618 (2000). (English translation of abstract).

European Search Report dated Jun. 5, 2013 issued in corresponding European Application No. 08 844 842.8.

* cited by examiner

ROLLING MILL FOR A PLATE OR A SHEET AND ITS CONTROL TECHNIQUE

This application is a national stage application of International Application No. PCT/JP2008/070251, filed 30 Oct. 2008, which claims priority to Japanese Application Nos. 2007-286176, filed 2 Nov. 2007; and 2008-261408, filed 8 Oct. 2008, each of which is incorporated by reference in its entirety.

TECHNICAL FIELD

The present invention relates to a rolling mill of a plate or a sheet controlled so that a pair of top and bottom work rolls are supplied with drive force by independent electric motors and its control technique.

BACKGROUND ART

In plate or sheet rolling by a rolling mill of a plate or a sheet designed so that a pair of top and bottom work rolls are supplied with drive force from independent electric motors, rolling trouble due to warping of the rolled material or flatness defects due to wavy shapes running through the plate/sheet width direction called "waviness", "full waves", "small waves", etc. occur with certainty, so various techniques have been proposed to prevent them.

For example, as art for controlling warping of a rolled material, there is the method of calculating the amount of rolling warping occurring in a pass from the actual values of the rolling load and the rolling torque of the previous pass, calculating a setting changing control amount for the difference in peripheral speeds of the top and bottom rolls to prevent this, and controlling the roll peripheral speeds based on the calculated setting changing control amount for the difference in peripheral speeds of the top and bottom rolls (for example, see Japanese Patent Publication (A) No. 7-164031).

However, the setting changing control amount for the difference in peripheral speeds of the top and bottom rolls for preventing warping changes due to various external factors, so accurately calculating this is difficult. For this reason, while this method exhibits certain effects, it cannot completely eliminate warping.

Further, as art for preventing small waves and waviness, there is the method of controlling the difference in peripheral speeds of the top and bottom rolls so that the rolled material warps upward (for example, see Japanese Patent Publication (A) No. 2002-346617). This is art based on the discovery that wavy shapes extending over the entire plate/sheet width called "small waves" or "waviness" occur at the rolling mill exit side due to the rolled material warping downward and striking the roller table. However, there are also small waves and waviness occurring not due to striking the roller table. In this case, there is no effect.

Further, as one function of control of the drive of electric motors of a rolling mill, control of the load balance to reduce the difference in drive torques between the top and bottom rolls has been realized (for example, see *Fuji Electric Journal*, Vol. 73, No. 11, pp. 614 to 618 (2000)). This system detects the difference in top and bottom torques to control the difference in top and bottom roll rotational speeds. It focuses on protection of the rolling equipment. To avoid external disturbances in the rolling speed control, the control becomes gentle with a large time constant. No effect of prevention of warping or waviness is obtained.

In this regard, while completely different in object from the present invention, Japanese Patent Publication (A) No. 54-71064 and Japanese Patent Publication (A) No. 60-9509 disclose embodiments similar to the present invention. These inventions are arts deliberately giving a difference to the peripheral speeds or torques of the top and bottom rolls to give the rolled material additional shear plastic deformation, that is, perform so-called differential peripheral speed rolling.

DISCLOSURE OF THE INVENTION

The problem to be solved by the present invention is the provision of a rolling mill of a plate or a sheet able to eliminate rolling trouble due to warping of the rolled material or flatness defects due to wavy shapes running across the plate/sheet width direction called "waviness", "full waves", "small waves", etc. and its control technique.

The inventors engaged in a wide range of research regarding the mechanism of occurrence of warping or flatness defects due to wavy shapes running across the plate/sheet width direction so as to solve this problem and as a result obtained the following technical discoveries:

(A) When warping or waviness occurs, the rolling torque balance of the top and bottom work rolls greatly changes.

(B) More specifically, when the rolled material warps upward, the bottom rolling torque changes rapidly in an increasing direction, while the top rolling torque changes rapidly in a decreasing direction, while when the rolled material warps downward, the torques change in the opposite directions.

(C) When waviness occurs, the balance of the rolling torques of the top and bottom work rolls changes continuously and cyclically.

(D) Furthermore, in the case of large warping such as causing rolling trouble, for example, in the case of hot strip finish rolling, extremely large torque changes exceeding 50% of the absolute value of the torque occur in opposite directions at the top and bottom rolls in a short time of around 1 second. Further, even in such a case, the total value of the torques of the top and bottom rolls is held substantially constant.

(E) Due to the above, if performing high response drive control for suppressing changes in the balance of rolling torques of the top and bottom work rolls, it is possible to prevent warping or flatness defects due to wavy shapes running across the plate/sheet width direction.

Further, the inventors engaged in various experimental studies and theoretical studies and as a result discovered that, as a control plan not contradicting rolling speed control, by employing the novel control system not existing in the prior art of controlling the electric motor driving one work roll using the roll rotational speed as a control target value and controlling the electric motor driving the other work roll using the rolling torque applied to the rolled material from the work roll driven by that electric motor becoming substantially constant as a control target and using the drive torque as a control amount, high response drive control for suppressing changes in the balance of rolling torques of the top and bottom work rolls can be realized.

Here, "making the rolling torque substantially constant" means making the time-series change of the ratio of the rolling torque of the torque control side work roll with respect to the total value of the top and bottom rolling torques 10% or so of the total torque or less while rolling a length corresponding to 100 times the rolling exit side plate/sheet thickness, preferably 5% or so or less.

(1) Based on the above findings and discoveries, the inventors came up with the idea of a rolling mill of a plate or a sheet able to eliminate rolling trouble due to warping of the rolled material or flatness defects due to wavy shapes running across the plate/sheet width direction called "waviness", "full waves", "small waves", etc. This invention is a rolling mill of a plate or a sheet having a pair of top and bottom work rolls and a pair of electric motors for independently driving the pair of work rolls, the rolling mill of a plate or a sheet characterized by being provided with a control means for controlling one electric motor using a roll rotational speed as a control target value and controlling the other electric motor using a rolling torque applied to the rolled material from the work roll driven by that electric motor becoming substantially constant as a control target and using the drive torque as a control amount.

In this respect, while completely different in object from the present invention, as mentioned above, Japanese Patent Publication (A) No. 54-71064 and Japanese Patent Publication (A) No. 60-9509 disclose embodiments similar to the present invention. These inventions are arts deliberately giving a difference to the peripheral speeds or torques of the top and bottom rolls to give the rolled material additional shear plastic deformation, that is, perform so-called differential peripheral speed rolling.

Japanese Patent Publication (A) No. 54-71064 discloses a rolling mill providing the drive electric motor of one of the top and bottom work rolls with a speed setting circuit and providing a torque comparison and control device for driving the other work roll by a designed torque ratio or torque difference from the torque of the work roll set in speed. In this art, the drive of the work roll not set in roll speed is controlled by the torque, but this torque control target value is determined based on an actual torque signal of the drive electric motor controlling the roll speed. However, according to research by the inventors, the torque of the drive electric motor controlling the roll speed may greatly, rapidly change due to changes in the angle of entry of the rolled material into the rolling mill etc. In such a case, in the above invention where this is directly input to the control circuit to determine the other torque control target value, the torque control target value itself will greatly and suddenly fluctuate. Control like in the present invention where the rolling torque of the side not controlling the speed is controlled to be substantially constant becomes impossible and warping and waviness cannot be prevented.

Further, Japanese Patent Publication (A) No. 60-9509 discloses the control technique of controlling an electric motor driving one work roll among the top and bottom work rolls by speed and controlling the electric motor of the other work roll by torque using the rolling torque value of the torque required for rolling minus the torque of the roll side controlled in speed as the torque target value. According to research of the inventors, as explained above, the torque of the work roll controlled in roll speed may greatly, rapidly change due to changes in the angle of entry of the rolled material into the rolling mill etc., but even in such a case, it is learned that the change in the total value of the torques of the top and bottom work rolls is small. Therefore, when subtracting the actual value of the torque of the work roll controlled in speed from the total torque, if the torque of the work roll controlled in speed greatly changes, the torque target value of the other roll greatly changes in an opposite direction from the roll controlled in speed, control like in the present invention where the rolling torque of the side not controlled in speed is controlled to be substantially constant becomes impossible, and warping and waviness cannot be prevented.

Further, in the inventions relating to the above two differential speed rolling arts, the drive torque and the rolling torque sometimes cannot be differentiated. For example, at the time of acceleration and deceleration, there is also the problem that the inertia of the drive system or reinforcement rolls makes it difficult to control the rolling torque acting between the rolled material and the work rolls to be substantially constant.

(2) The inventors further came up with the idea of a rolling mill of a plate or a sheet able to prevent in advance abnormal rotation at the time of no load before the rolled material is pulled into the mill. This invention is a rolling mill of a plate or a sheet as set forth in (1) characterized by being provided with a control means for controlling both electric motors using the roll rotational speed as a control target value before the rolled material is pulled into the mill and switching control of one electric motor to control using the drive torque as a control amount after the rolled material is pulled in.

(3) The inventors further came up with the idea of a rolling mill of a plate or a sheet able to prevent abnormal rotation at the time of no load after the rolled material is pulled into the mill. This invention is a rolling mill of a plate or a sheet as set forth in (1) or (2) characterized by being provided with a control means continuing to control one electric motor using the drive torque as a control amount until before a tail end of the rolled material passes and switching to control of both electric motors using the roll rotational speed as a control target value right before the tail end passes.

(4) The inventors further came up with the idea of a rolling mill of a plate or a sheet able to maintain the balance of rolling torques of the top and bottom work rolls even under rolling conditions of severe acceleration and deceleration. This invention is a rolling mill of a plate or a sheet as set forth in any of (1) to (3) characterized by being provided with a control means for giving a drive torque control amount and controlling an electric motor so that a rolling torque of the drive torque measurement value minus the torque due to the inertial force of the drive system and roll system becomes a control target value.

(5) Similarly, the inventors came up with the idea of a rolling mill of a plate or a sheet able to maintain the balance of the rolling torques of the top and bottom work rolls even under rolling conditions of severe acceleration and deceleration. This invention is a rolling mill of a plate or a sheet as set forth in any of (1) to (3) characterized by being provided with a control means for giving a drive torque control amount and controlling an electric motor so that a rolling torque of a spindle torque measurement value minus the torque due to the inertial force of the roll system becomes a control target value.

(6) Further, the inventors came up with the idea of a rolling mill of a plate or a sheet able to maintain the balance of the rolling torques of the top and bottom work rolls. This invention is a rolling mill of a plate or a sheet as set forth in any of (1) to (5) characterized by being provided with a control means for changing a drive torque control target value of an electric motor controlling the drive torque during rolling.

(7) One example is a rolling mill of a plate or a sheet as set forth in (6) characterized by being provided with a control means for changing the drive torque control target value changed during rolling in a ramp shape.

(8) Another example is a rolling mill of s plate or a sheet as set forth in (6) or (7) characterized by being provided with a control means for changing the drive torque control target value changing during rolling through time-series smoothing based on a drive torque measurement value or spindle torque measurement value of a work roll driven by the electric motor controlled using the roll rotational speed as a control target value.

(9) Still another example is a rolling mill of a plate or a sheet as set forth in any one of (6) to (8) characterized by being provided with a control means for changing the drive torque control target value changing during rolling in accordance with fluctuations in the rolling load.

(10) In addition, the inventors came up with the idea of a control technique for a plate or a sheet rolling able to eliminate running trouble due to warping of the rolled material or flatness defects due to wavy shapes running across the plate/sheet width direction called "waviness", "full waves", "small waves", etc. This invention is a control technique of a rolling mill of a plate or a sheet designed so that a pair of top and bottom work rolls are supplied with drive power by independent electric motors, the control technique of a rolling mill of a plate or a sheet characterized by controlling one electric motor using a roll rotational speed as a control target value and controlling the other electric motor using the rolling torque applied to the rolled material from the work roll driven by that electric motor becoming substantially constant as a control target and using the drive torque as a control amount.

(11) The inventors further came up with the idea of a control technique of a rolling mill of a plate or a sheet able to prevent in advance abnormal rotation at the time of no load before the rolled material is pulled into the mill. This invention is a control technique of a rolling mill of a plate or a sheet as set forth in (10) characterized by controlling both electric motors using the roll rotational speed as a control target value before the rolled material is pulled into the mill and switching control of one electric motor to control using the drive torque as a control amount after the rolled material is pulled in.

(12) The inventors further came up with the idea of a control technique of a rolling mill of a plate or a sheet able to prevent abnormal rotation at the time of no load after the rolled material is pulled into the mill. This invention is a control technique of a rolling mill of a plate or a sheet as set forth in (10) or (11) characterized by continuing to control one electric motor using the drive torque as a control amount until before a tail end of the rolled material passes and switching to control using the roll rotational speed as a control target value for both electric motors right before the tail end passes.

(13) The inventors further came up with the idea of a control technique of a rolling mill of a plate or a sheet able to maintain the balance of rolling torques of the top and bottom work rolls even under rolling conditions of severe acceleration and deceleration. This invention is a control technique of a rolling mill of a plate or a sheet as set forth in any of (10) to (12) characterized by giving a drive torque control amount and controlling an electric motor so that a rolling torque of the drive torque measurement value minus the torque due to the inertial force of the drive system and roll system becomes a control target value.

(14) Similarly, the inventors came up with the idea of a control technique of a rolling mill of a plate or a sheet able to maintain the balance of the rolling torques of the top and bottom work rolls even under rolling conditions of severe acceleration and deceleration. This invention is a control technique of a rolling mill of a plate or a sheet as set forth in any of (10) to (12) characterized by giving a drive torque control amount and controlling an electric motor so that a rolling torque of a spindle torque measurement value minus the torque due to the inertial force of the roll system becomes a control target value.

(15) Further, the inventors came up with the idea of a control technique of a rolling mill of a plate or a sheet able to maintain the balance of the rolling torques of the top and bottom work rolls. This invention is a control technique of a rolling mill of a plate or a sheet as set forth in any of (10) to (14) characterized by changing a drive torque control target value of an electric motor controlling the drive torque during rolling.

(16) One example is a control technique of a rolling mill of a plate or a sheet as set forth in (15) characterized by changing the drive torque control target value changed during rolling in a ramp shape.

(17) Another example is a control technique of a rolling mill of s plate or a sheet as set forth in (15) or (16) characterized by changing the drive torque control target value changing during rolling through time-series smoothing based on a drive torque measurement value or spindle torque measurement value of a work roll driven by the electric motor controlled using the roll rotational speed as a control target value.

(18) Still another example is a control technique of a rolling mill of a plate or a sheet as set forth in any one of (15) to (17) characterized by changing the drive torque control target value changing during rolling in accordance with fluctuations in the rolling load.

The effects obtained by the above invention are as follows: That is, according to the rolling mill for a plate or a sheet and its control technique according to the present invention which control one electric motor using the roll rotational speed as a control target value and controlling the other electric motor using the rolling torque applied to the rolled material from the work roll driven by that electric motor becoming substantially constant as a control target and using the drive torque as a control amount, rapid changes in the balance of the rolling torques of the top and bottom work rolls can be suppressed and running trouble due to warping of the rolled material or flatness defects due to wavy shapes running across the plate/sheet width direction called "waviness", "full waves", "small waves", etc. can be eliminated.

BEST MODE FOR CARRYING OUT THE INVENTION

Below, referring to FIG. 1 to FIG. 10, best modes for carrying out the present invention will be explained.

In the rolling mill for a plate or a sheet and its control technique according to the present invention, there is provided a rolling mill of a plate or a sheet where a top work roll 2 and a bottom work roll 3 are driven by independent drive use electric motors 5 and 6, in which high response drive control for suppressing changes in the balance of the rolling torques of the top and bottom work rolls is realized by controlling the electric motor driving one work roll using the roll rotational speed as a control target value and by controlling the electric motor driving the other work roll using the rolling torque applied to the rolled material from the work roll driven by that electric motor becoming substantially constant as a control target and using the drive torque as a control amount.

Figure 1:
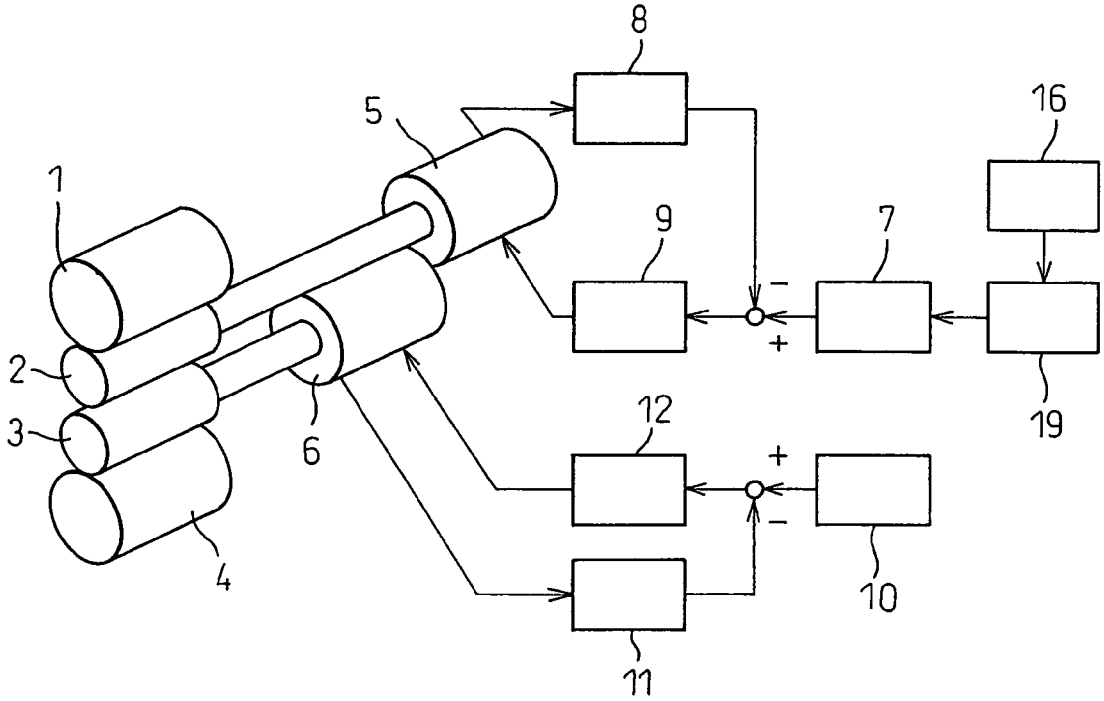
FIG. 1 is a view of the configuration showing a first aspect of a rolling mill for a plate or a sheet and its control technique according to the present invention.

FIG. 1 is a view of the configuration showing the first aspect of a rolling mill for a plate or a sheet and its control technique according to the present invention and shows an example of control of the top work roll 2 by the drive torque and control of the bottom work roll 3 by the roll rotational speed.

In the first aspect, as shown in FIG. 1, the top drive electric motor 5 driving the top work roll 2 is controlled to make a top drive torque measurement value 8 match a top drive torque target value 7 computed by a top drive torque target value processor 19 for realizing a given top rolling torque target value 16, while the bottom drive electric motor 6 driving the bottom work roll 3 is controlled to make a bottom work roll rotational speed measurement value 11 match a given bottom work roll rotational speed target value 10. That is, the top drive electric motor 5 is controlled using the top drive torque as a control amount and the bottom drive electric motor 6 is controlled using the roll rotational speed as a control target value.

To realize such control, a top drive control circuit outputs a top drive torque control amount 9 to the top drive electric motor 5 based on the difference between the top drive torque target value 7 and the top drive torque measurement value 8, while a bottom drive control circuit outputs a bottom work roll rotational speed control amount 12 to the bottom drive electric motor 6 based on the difference between the bottom work roll rotational speed target value 10 and the bottom work roll rotational speed measurement value 11.

In the rolling mill for a plate or a sheet and its control technique according to the present invention, in this way, the electric motor driving one work roll is controlled in only the roll rotational speed and is not controlled in the drive torque, while the electric motor driving the other work roll is controlled in only the drive torque and is not controlled in the roll rotational speed. However, the rolling mill for a plate or a sheet and its control technique according to the present invention can exhibit a similar performance in the speed control of a rolled material as the case of controlling the speed of the top and bottom rolls according to the prior art and can prevent changes in the rolling torque balance of the top and bottom work rolls.

This is because usual rolling is performed in a state where the rolling ratio is substantially constant, so the total torque of the rolling torques of the top and bottom work rolls becomes substantially constant, but if controlling the rolling torque of one work roll to be constant, the rolling torque of the other work roll can also be controlled to be substantially constant, so changes in the rolling torque balance of the top and bottom work rolls can be prevented. That is, the other rolling torque for which roll rotational speed control is being performed also becomes substantially constant and the position of the neutral point where the strip between the work roll and the rolled material becomes zero can also be maintained constant, so the speed of the rolled material is also held substantially constant.

Therefore, according to rolling mill for a plate or a sheet and its control technique according to the present invention, where one electric motor is controlled using the roll rotational speed as a control target value, while the other electric motor controlled using the rolling torque applied to the rolled material from the work roll driven by that electric motor becoming substantially constant as a control target and using the drive torque as a control amount, it is possible to suppress sudden changes in the rolling torque balance of the top and bottom work rolls and possible to eliminate running trouble due to warping of the rolled material or flatness defects due to wavy shapes in the plate or sheet width direction called "waviness", "full waves", "small waves", etc.

Further, the control according to the present invention is preferably performed over the entire length of the plate or sheet rolling. This is not a treatment type response as explained in Japanese Patent Publication (A) No. 7-164031 and No. 2002-346617, but constant control, so the response is fast and warping or squeezing can be prevented in advance.

Note that FIG. 1 shows an example where the top work roll 2 is controlled in drive torque and the bottom work roll 3 is controlled in roll rotational speed, but the top and bottom control may also be switched. Further, when determining the control amount from the difference of the target value and measurement value, for example, it is possible to interpose PID control gain or apply other normally used control techniques of course and to use for example a computer as the control means for controlling the pair of electric motors independently driving the pair of the top and bottom work rolls in the above way so that one is controlled using the roll rotational speed as a control target value and the other is controlled using the drive torque as a control amount, for example, a computer. Further, by learning the model for calculating the setting of the rolling torque target value from the actual rolling data, it is possible to raise the precision of calculation of the rolling torque setting and as a result reduce the difference in torques of the top and bottom work rolls.

Figure 2:
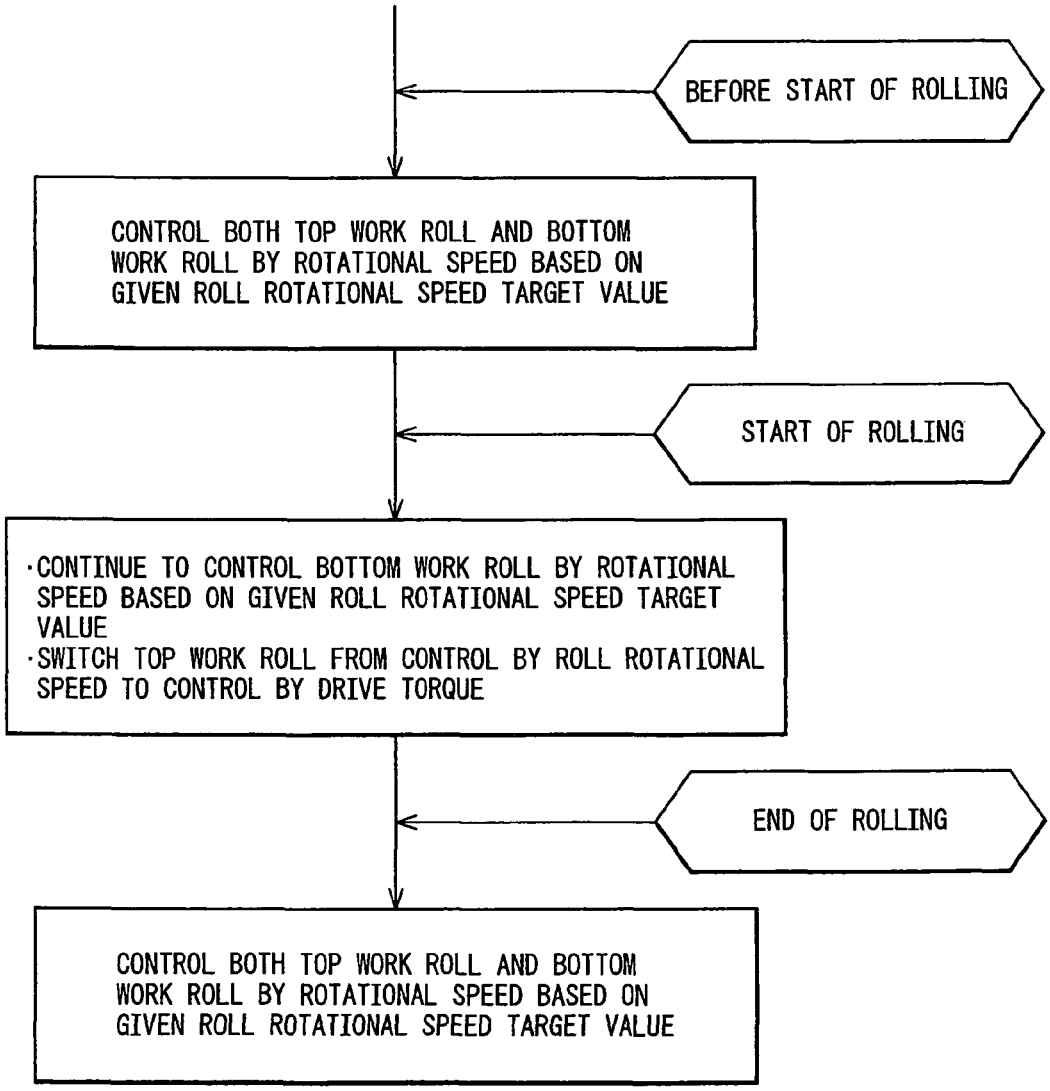
FIG. 2 is a control flow chart showing a second aspect of a rolling mill for a plate or a sheet and its control technique according to the present invention.

FIG. 2 is a control flow chart showing a second aspect of a rolling mill for a plate or a sheet and its control technique according to the present invention. In the second aspect, as shown in FIG. 2, in addition to the first aspect, both electric motors are controlled using the roll rotational speed as a control target value before the start of rolling, that is, before the rolled material is pulled in to the mill. Further, after the start of rolling, that is, after the rolled material is pulled in, the control of one electric motor is switched to control using the drive torque as the control amount. This is to limit the control of one electric motor controlled using the drive torque as a control amount to only during roll and thereby prevent abnormal rotation at the time of no load and thereby achieve more stable operation and protection of the equipment.

Further, after switching control of one electric motor after the rolled material is pulled in to the mill to control using the drive torque as a control amount, this aspect continues to control one electric motor using the drive torque as the control amount until before the tail end of the rolled material passes and then switches to controlling both electric motors using the roll rotational speed as the control target value right before the tail end passes. Due to this, it is possible to prevent in advance abnormal rotation at the time of no load after the end of rolling.

For judging if rolling has started, for example, it is possible to continuously measure the rolling load and judge the point where the rolling load becomes a certain threshold value or more, for example, 30% of the set calculated load or more, as the starting point of rolling. Further, it is also possible to continuously compute the drive torque from the motor current and judge the point of time when the drive torque computed value becomes a certain threshold value or more, for example, 30% of the set calculated torque or more, as the starting point of rolling.

On the other hand, for judging if rolling has ended, conversely from the judgment of the start of rolling, it is possible to judge the point of time when the rolling load or drive torque becomes for example a set value or less than 30% of the actual steady value as the rolling end point. Further, if the rolled material is removed in the state where drive torque control of the top work roll is continuing, the speed of the top roll will rapidly increase, so an operation is also possible judging the case where the top work roll rotational speed becomes a certain value or more as the rolling end and returning to roll rotational speed control.

Note that FIG. 2 showing the second aspect shows an example where the top work roll is controlled in drive torque and the bottom work roll is controlled in roll rotational speed, but in the same way as the first aspect, the top and bottom controls may also be switched.

Figure 3:
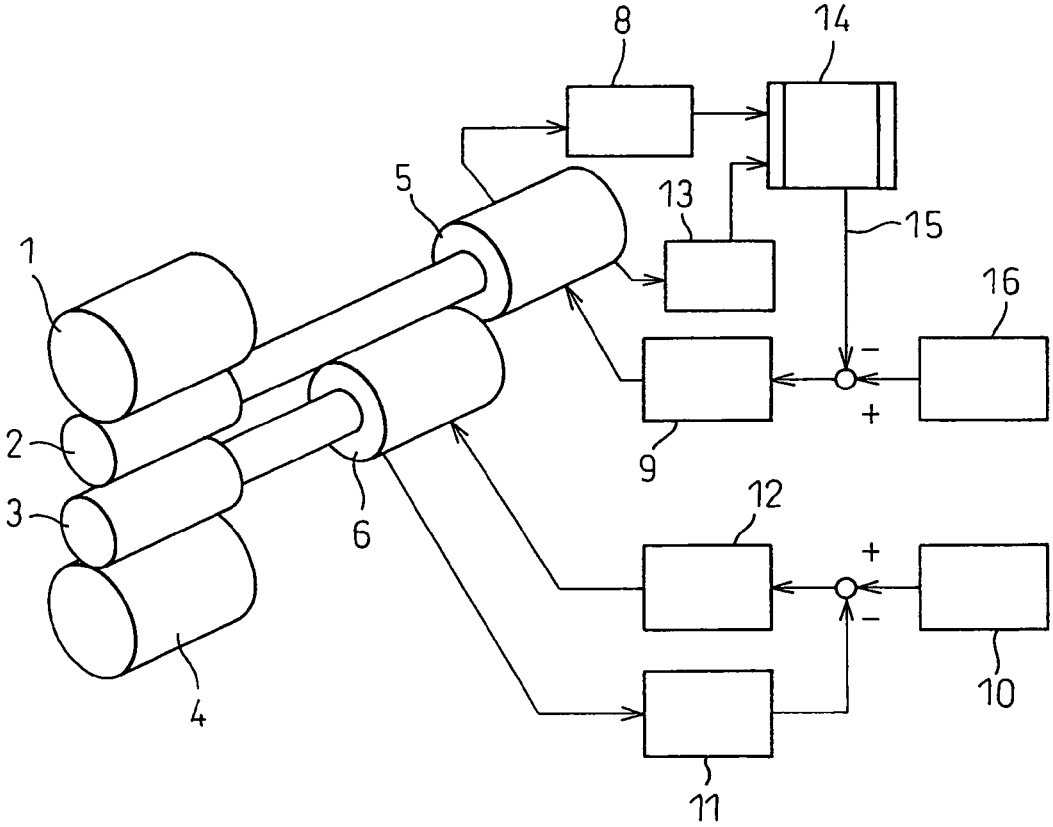
FIG. 3 is a view of the configuration showing a third aspect of a rolling mill for a plate or a sheet and its control technique according to the present invention.

FIG. 3 is a view of the configuration showing a third aspect of a rolling mill for a plate or a sheet and its control technique according to the present invention. This is an example where top work roll 2 is controlled in drive torque and the bottom work roll 3 is controlled in roll rotational speed.

The third aspect, as shown in FIG. 3, controls the top drive electric motor 5 driving the top work roll 2 so that the top rolling torque computed value 15 matches with a given top rolling torque target value 16. That is, this gives a drive torque control amount and controls the top drive electric motor 5 so that top rolling torque obtained by subtracting from the top drive torque measurement value 8 the inertial forces of the drive system and the roll system matches the control target value. At this time, even if the top rolling torque target value 16 is constant, for example, at the time of acceleration and deceleration, the change in the inertial forces of the drive system and the roll system has to be borne by the drive torque, so the given drive torque control amount changes.

Here, the "drive torque" spoken of in the present invention means the torque generated at a drive use electric motor and includes, in addition to the rolling torque, the contributions of the bearing resistance and the inertial forces of the drive system and roll system. Further, the "rolling torque" means the torque directly corresponding to the plastic deformation work of the rolled material and means the torque determined by the distribution of rolling pressure acting between the rolled material and the work rolls.

Further, the inertial force of the roll system includes not only the inertial force of the reinforcement rolls, but also the inertial force of the work rolls. Further, when there are not shown intermediate rolls, this becomes the total of the inertial forces of the rolls including the intermediate rolls.

To realize this control, the top rolling torque processor 14 calculates the acceleration of the top drive system from the top work roll rotational speed measurement value 13, calculates the contribution of the acceleration of the top drive system to the drive torque while considering the moment of inertia of the top drive system, that is, the inertial forces of the drive system and the roll system, and subtracts this from the top drive torque measurement value 8 to estimate the net top rolling torque computed value 15. Note that strictly speaking, to calculate the rolling torque from the drive torque, it is necessary to calculate and subtract the contribution of the bearing resistance, but usually the contribution of the bearing resistance is small, so this procedure may be omitted.

Further, the top drive control circuit outputs the top drive torque control amount 9 to the top drive electric motor 5 based on the difference of the top rolling torque computed value 15, obtained by subtracting from the top drive torque measurement value 8 the torque due to the inertial forces of the drive system and roll system, and the top rolling torque target value 16.

In this way, the third aspect gives a drive torque control amount and controls the top drive electric motor 5 so that the rolling torque of the top drive torque measurement value 8 minus the torque due to the inertial forces of the drive system and roll system matches a control target value, so it is possible to maintain the balance of the rolling torques of the top and bottom work rolls even under rolling conditions of severe acceleration and deceleration.

Note that the bottom drive electric motor 6 driving the bottom work roll 3 is controlled so that the bottom work roll rotational speed measurement value 11 matches a given bottom work roll rotational speed target value 10. To realize such control, the bottom drive control circuit outputs the bottom work roll rotational speed control amount 12 to the bottom drive electric motor 6 based on the difference between the bottom work roll rotational speed target value 10 and the bottom work roll rotational speed measurement value 11 in the same way as the first and second aspects.

Further, FIG. 3 shows an example where the top work roll 2 is controlled in drive torque and the bottom work roll 3 is controlled in roll rotational speed, but the top and bottom controls may also be switched.

Figure 4:
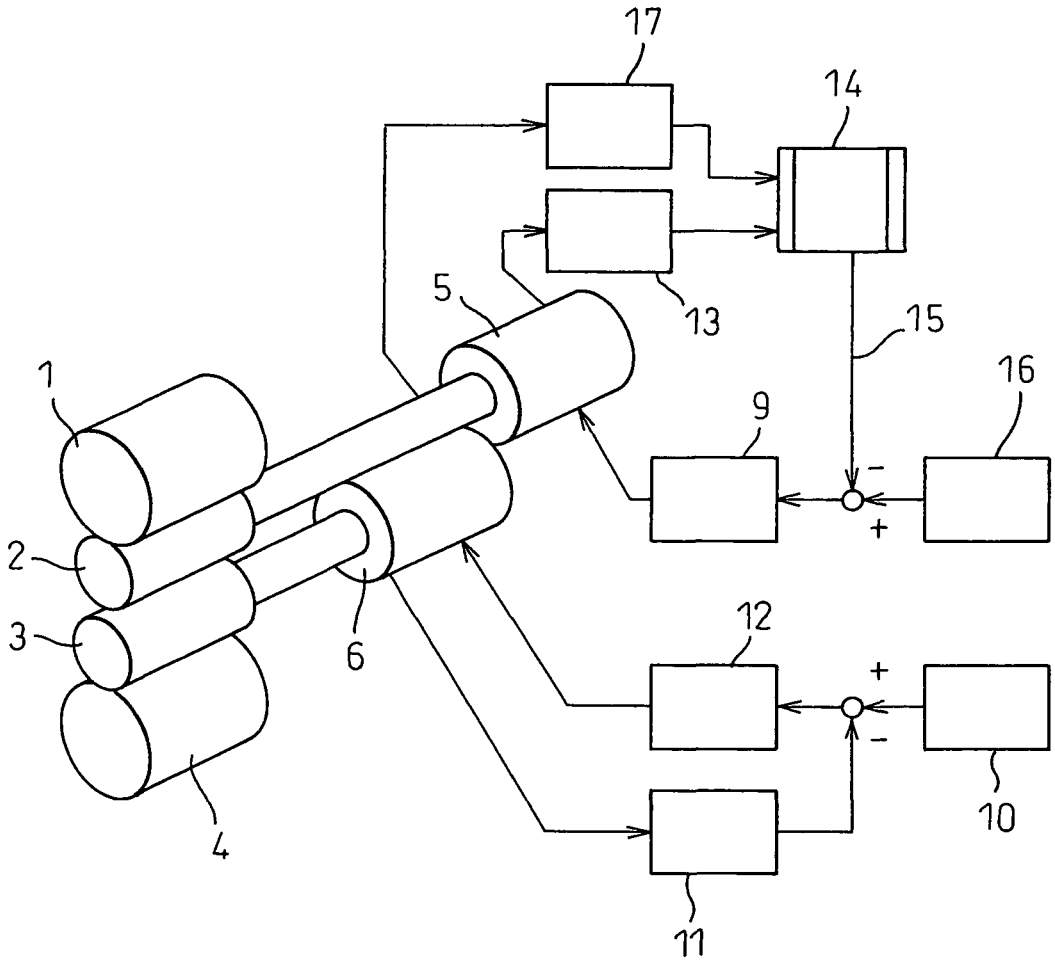
FIG. 4 is a view of the configuration showing a fourth aspect of a rolling mill for a plate or a sheet and its control technique according to the present invention.

FIG. 4 is a view of the configuration showing a fourth aspect of a rolling mill for a plate or a sheet and its control technique according to the present invention and shows an example where the top work roll 2 is controlled in drive torque control and the bottom work roll 3 is controlled in roll rotational speed. In the fourth aspect, as shown in FIG. 4, this gives a drive torque control amount and controls the top drive electric motor 5 so that the top rolling torque of the top spindle torque measurement value 17 minus the torque due to the inertial force of the roll system matches a control target value.

Here, the "spindle torque" referred to in the present invention means the torque applied to a spindle transmitting the rolling torque to a work roll and includes, in addition to the rolling torque, contributions of the bearing resistance and inertial force of the roll system. Further, it includes the contribution of the inertial force of part of the spindle from a torque sensor to the work roll, so that part of the spindle is deemed included in the roll system.

To realize such control, the top rolling torque processor 14 calculates the contribution of the acceleration of the top roll system calculated from the top work roll rotational speed measurement value 13 to the drive torque while considering the inertial force of the top roll system and subtracts this from the top spindle torque measurement value 17 to estimate the net top rolling torque computed value 15.

Further, the top drive control circuit outputs the top drive torque control amount 9 to the top drive electric motor 5 based on the difference of the top rolling torque computed value 15, obtained by subtracting from the top spindle torque measurement value 17 the torque due to the inertial force of the top roll system, and the top rolling torque target value 16.

Further, the measurement device for obtaining the top spindle torque measurement value 17 is configured to be able to measure the torque of the top spindle part so as to eliminate the effect of the inertial force of the drive system. This device need only be one of a general configuration observing and extracting the torsional deformation occurring in the spindle part due to the torque by a strain gauge.

In this way, the fourth aspect gives a drive torque control amount to control the top drive electric motor 5 so that the rolling torque, obtained by subtracting from the top spindle torque measurement value 17 the torque due to the inertial force of the top roll system, matches the control target value, so it is possible to maintain the balance of the rolling torques of the top and bottom work rolls even under rolling conditions of severe acceleration and deceleration.

Note that the bottom drive electric motor 6 for driving the bottom work roll 3 is controlled so that the bottom work roll rotational speed measurement value 11 matches the given bottom work roll rotational speed target value 10. To realize this control, the bottom drive control circuit outputs the bottom work roll rotational speed control amount 12 to the bottom drive electric motor 6 based on the difference between the bottom work roll rotational speed target value 10 and the bottom work roll rotational speed measurement value 11 in the same way as the first aspect etc.

Further, FIG. 4 shows an example where the top work roll 2 is controlled in drive torque and the bottom work roll 3 is controlled in roll rotational speed, but the top and bottom controls may also be switched.

Above, the explanation was given of a rolling mill for a plate or a sheet and its control technique according to the present invention wherein changes in the balance of the rolling torques of the top and bottom work rolls are prevented by controlling the electric motor driving one work roll using the roll rotational speed as a control target value and controlling the electric motor driving the other work roll using the drive torque as a control amount.

However, to more suitably control the balance of the rolling torques of the top and bottom work rolls, it is preferable to further control the latter electric motor using the drive torque as the control amount to change the drive torque control target value during rolling. In this case, if rapidly changing the control target value, the balance of the rolling torques of the top and bottom work rolls will rapidly change and may cause warping or waviness, so the rate of change is preferably limited.

Figure 5:
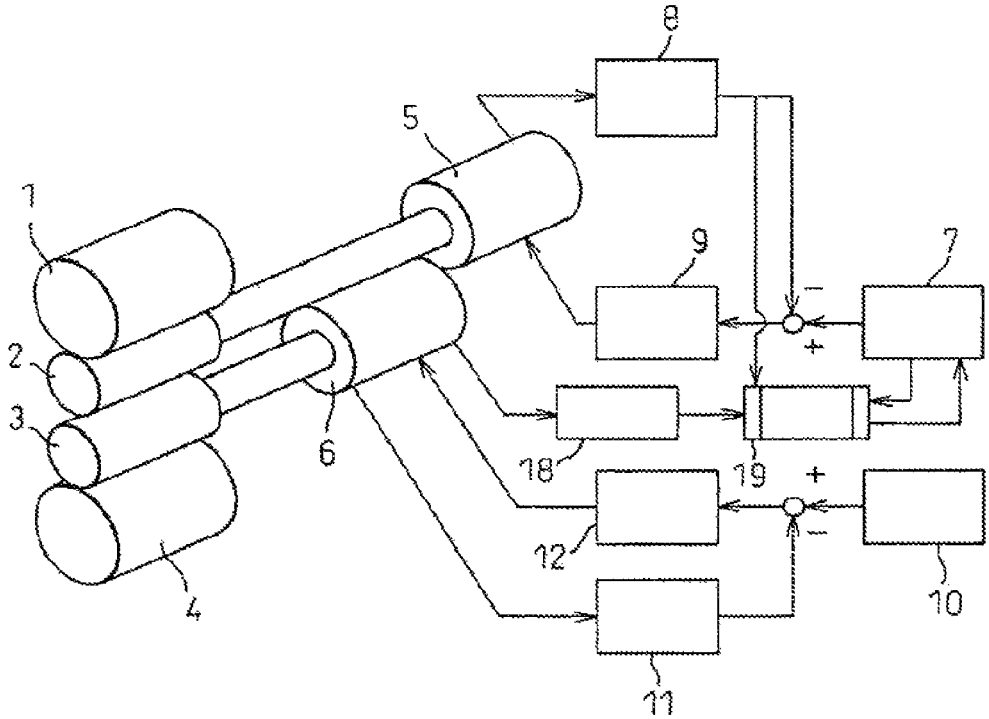
FIG. 5 is a view of the configuration showing a fifth aspect of a rolling mill for a plate or a sheet and its control technique according to the present invention.

FIG. 5 is a view of the configuration showing a fifth aspect of a rolling mill for a plate or a sheet and its control technique according to the present invention and shows an example where the top work roll 2 is controlled in drive torque and the bottom work roll 3 is controlled in roll rotational speed. It is an example where a top drive torque target value processor 19 is provided for calculating an updated value of the top drive torque target value 7.

The top drive torque target value processor 19 calculates the updated value of the top drive torque target value 7 based on the bottom drive torque measurement value 18 and top drive torque measurement value 8 and the current top drive torque target value 7.

At the time of calculating the updated value, it is preferable to process the time series data of the bottom drive torque measurement value 18 and the top drive torque measurement value 8 by exponential smoothing or other time series smoothing to remove measurement noise and other unnecessary high frequency fluctuation components.

Further, it is preferable to perform an operation multiplying the total value of the top and bottom drive torque measurement values obtained in this way with a desired ratio $\alpha$ (usually ½) to obtain an updated value of the top drive torque target value 7. For example, when the bottom drive torque increases, the top drive roll torque will not change that much under torque control, but the total value of the top and bottom drive torques will increase, so the top drive torque target value is also updated in an increasing direction. Therefore, when the amount of change of the updated value becomes excessive compared with the current top drive torque target value 7, the balance of the rolling torques of the top and bottom work rolls may temporarily be lost, so to prevent this, it is preferable to apply predetermined upper and lower limits to the amount of change of the top drive torque target value.

In this embodiment, the rolling torque is not positively expressed as a control target value, but the object is in the final analysis the maintenance of the balance of the rolling torques of the top and bottom work rolls. This is considered in the top drive torque target value processor 19. That is, when there is a difference in the moment of inertia of the top and bottom drive systems, at the time of acceleration and deceleration, the top drive torque target value is calculated so as to maintain the balance of the rolling torques of the top and bottom work rolls considering the difference of this inertia term.

Note that FIG. 5 shows an example where the top work roll 2 is controlled in drive torque and the bottom work roll 3 is controlled in roll rotational speed, but the top and bottom controls may also be switched.

Figure 6:
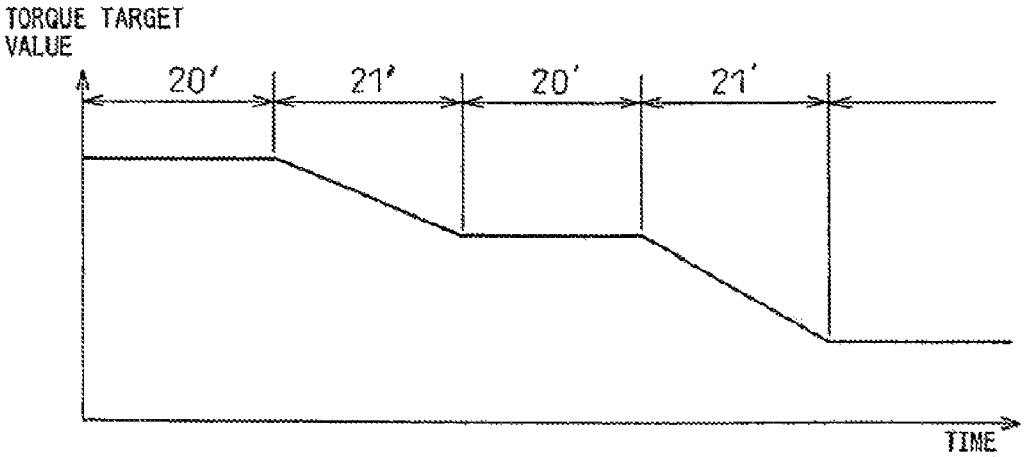
FIG. 6 is an explanatory view showing a sixth aspect of a rolling mill for a plate or a sheet and its control technique according to the present invention.

FIG. 6 is a view of the configuration showing a sixth aspect of a rolling mill for a plate or a sheet and its control technique according to the present invention. In the case of conditions where the change in the rolling conditions is relatively gentle, there is no need to change the control value continuously like in the example of FIG. 5, so for example the procedure for changing the drive torque target value of the aspect shown in FIG. 6 may also be employed. That is, a sampling period 20 and a drive torque target value changing period 21 are provided, an updated value of the drive torque target is calculated from the drive torque measurement value obtained in the sampling period 20, and, in the following drive torque target value changing period 21, the drive torque target is changed to a ramp shape toward the drive torque target updated value. Note that "change in a ramp shape" means not changing in a step-wise manner, but changing linearly by a constant rate of change toward the updated value.

The ramp shape change in the target value is not a rapid change of the target value and the balance of the rolling torques of the top and bottom work rolls is not lost, so no warping or waviness is caused. However, in this aspect as well, the balance of the rolling torques of the top and bottom work rolls may be temporarily lost, so it is preferable to apply predetermined upper and lower limits to the rate of change of the drive torque target value. The upper limit value of the absolute value of this rate of change of torque is, for example, made 10% or so or less of the total top and bottom torque while rolling a length corresponding to 100 times the plate or sheet thickness at the rolling exit side, preferably 5% or so or less.

Note that as explained above, the procedure for change of the torque target value of the aspect shown in FIG. 6 is employed when the change in the rolling conditions is relatively gentle. The sampling period 20 and torque target value changing period 21 are, for example, set to ranges of 5 to 10 seconds or so.

Figure 7:
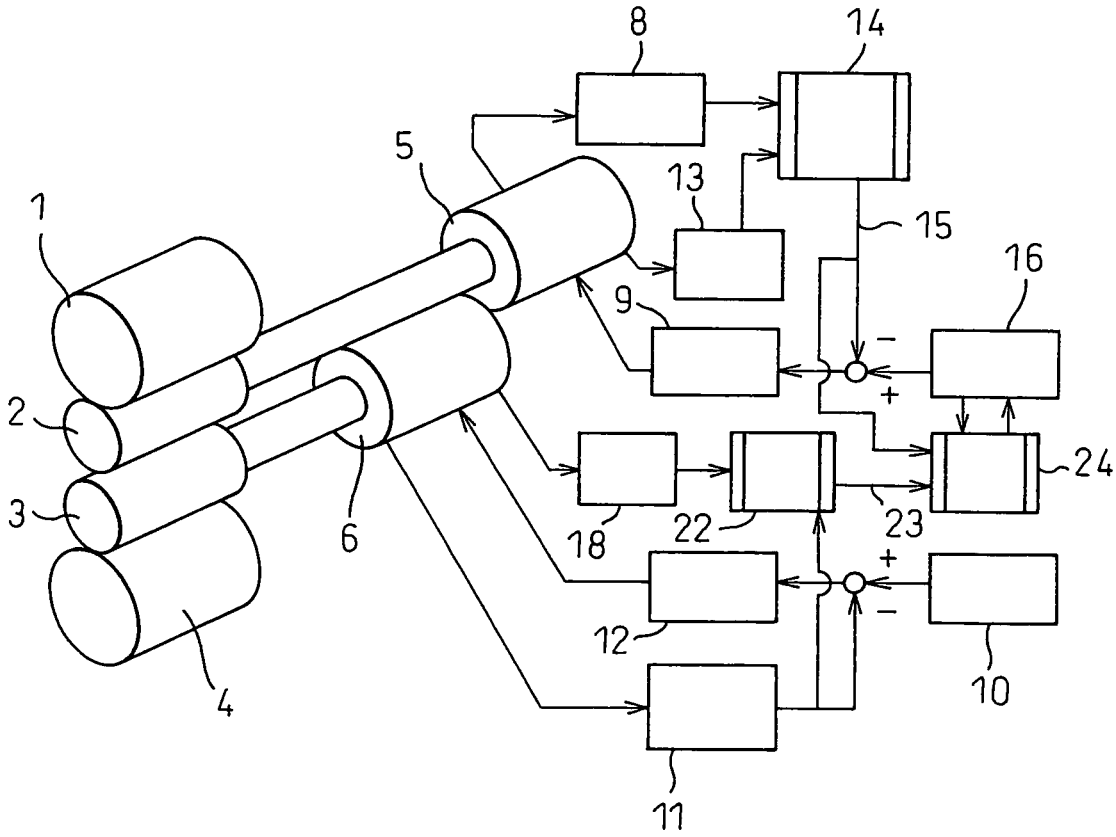
FIG. 7 is a view of the configuration showing a seventh aspect of a rolling mill for a plate or a sheet and its control technique according to the present invention.

FIG. 7 is a view of the configuration showing a seventh aspect of a rolling mill for a plate or a sheet and its control technique according to the present invention and shows an example where the top work roll 2 is controlled in drive torque control and the bottom work roll 3 is controlled in roll rotational speed.

The top rolling torque processor 14 calculates the acceleration of the top drive system from the top work roll rotational speed measurement value 13, calculates the contribution of the acceleration of the top drive system to the drive torque considering the moment of inertia of the top drive system, that is, the inertial forces of the drive system and the roll system, and subtracts this from the top drive torque measurement value 8 to estimate the net top rolling torque computed value 15.

Further, the top drive control circuit outputs the top drive torque control amount 9 to the top drive electric motor 5 based on the difference between the top rolling torque computed value 15, obtained by subtracting from the top drive torque measurement value 8 the torque due to the inertial forces of the drive system and the roll system, and the top rolling torque target value 16.

On the other hand, the top rolling torque target value processor 24, for example, processes the time-series data of the top rolling torque computed value 15 and the bottom rolling torque computed value 23 by exponential smoothing or other time-series smoothing to remove the measurement noise or other unnecessary high frequency fluctuation components, multiplies the total value of the thus obtained top and bottom rolling torque computed values with a desired ratio $\alpha$ (usually ½), and uses the result as the updated value of the top rolling torque target value 16.

However, when the amount of change of the updated value becomes excessive compared with the current top rolling torque target value 16, the balance of the rolling torques of the top and bottom work rolls may be temporarily lost, so it is preferable to apply predetermined upper and lower limits to the amount of change of the top rolling torque target value 16.

The bottom rolling torque processor 22, in the same way as the top rolling torque processing, calculates the acceleration of the bottom drive system from the bottom work roll rotational speed measurement value 11, calculates the contribution of the acceleration of the bottom drive system to the drive torque considering the moment of inertia of the bottom drive system, and subtracts this from the bottom drive torque measurement value 18 to estimate the net bottom rolling torque computed value 23.

Further, the bottom drive control circuit outputs a bottom work roll rotational speed control amount 12 to the bottom drive electric motor 6 based on the difference between the bottom work roll rotational speed target value 10 and the bottom work roll rotational speed measurement value 11.

In this way, the seventh aspect gives a drive torque control amount and controls the top drive electric motor 5 so that the rolling torque obtained by subtracting from the top drive torque measurement value 8 the torque due to the inertial forces of the drive system and the roll system matches a control target value and, further, updates the control target value during rolling, so it is possible to maintain the balance of the rolling torques of the top and bottom work rolls even under rolling conditions of severe acceleration and deceleration.

Note that FIG. 7 shows an example where the top work roll 2 is controlled in drive torque and the bottom work roll 3 is controlled in roll rotational speed, but the top and bottom controls may also be switched.

Further, in the aspect of FIG. 7, the top drive torque target value is not positively expressed at the control circuit, but this is because the control circuit is expressed simply. If accurately expressing it when calculating the top drive torque control amount from the difference of the top rolling torque target value and the top rolling torque computed value, this aspect updates the top drive torque target value from the difference between the top rolling torque target value and the top rolling torque computed value and calculates the top drive torque control amount from this updated top drive torque target value and top drive torque measurement value. It still controls the system based on the concept of the top drive torque target value.

Figure 8:
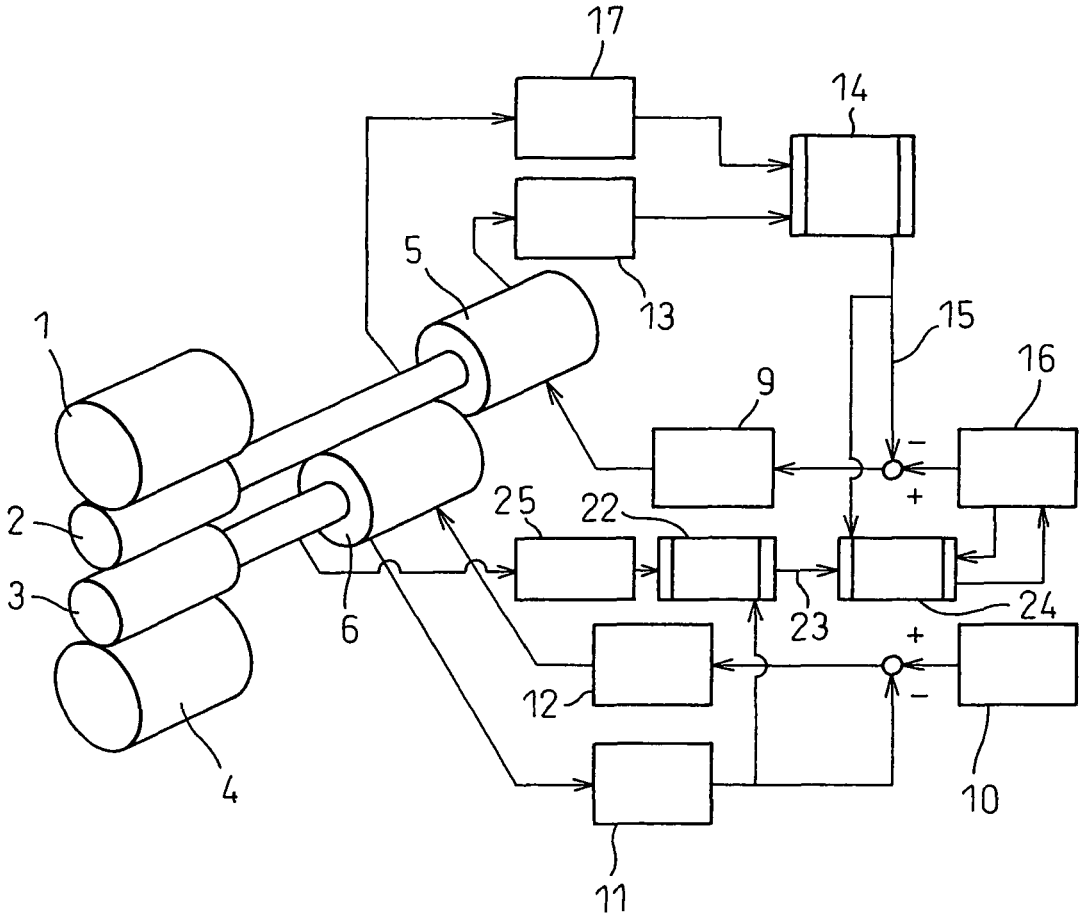
FIG. 8 is a view of the configuration showing an eighth aspect of a rolling mill for a plate or a sheet and its control technique according to the present invention.

FIG. 8 is a view of the configuration showing an eighth aspect of a rolling mill for a plate or a sheet and its control technique according to the present invention and shows an example where the top work roll 2 is controlled in drive torque and the bottom work roll 3 is controlled in roll rotational speed.

The eighth aspect, as shown in FIG. 8, gives a drive torque control amount and controls the top drive electric motor 5 so that the top rolling torque, obtained by subtracting from the top spindle torque measurement value 17 the torque due to the inertial force of the roll system, matches with the control target value.

To realize this control, the top rolling torque processor 14 calculates the contribution of the acceleration of the top roll system, calculated from the top work roll rotational speed measurement value 13 considering the inertial force of the top roll system, and subtracts it from the top spindle torque measurement value 17 to estimate the net top rolling torque computed value 15.

Further, the top drive control circuit outputs the top drive torque control amount 9 to the top drive electric motor 5 based on the difference between the top rolling torque computed value 15, obtained by subtracting from the top spindle torque measurement value 17 the torque due to the inertial force of the top roll system, and the top rolling torque target value 16.

Further, the measurement device for obtaining the top spindle torque measurement value 17 is configured to be able to measure the torque of the top spindle part so as to eliminate the effect of the inertial force of the drive system.

On the other hand, the top rolling torque target value processor 24, for example, processes the time-series data of the top rolling torque computed value 15 and the bottom rolling torque computed value 23 by exponential smoothing or other time-series smoothing to remove the measurement noise or other unnecessary high frequency fluctuation components, multiplies the total value of the thus obtained top and bottom rolling torque computed values with a desired ratio $\alpha$ (usually ½), and uses the result as the updated value of the top rolling torque target value 16.

However, when the amount of change of the updated value becomes excessive compared with the current top rolling torque target value 16, the balance of the rolling torques of the top and bottom work rolls may be temporarily lost, so it is preferable to apply predetermined upper and lower limits to the amount of change of the top rolling torque target value 16.

Note that the measurement device for obtaining the bottom spindle torque measurement value 25, in the same way as above, is configured to be able to measure the torque of the bottom spindle part so as to eliminate the effect of the inertial force of the drive system.

Further, the bottom rolling torque processor 22, in the same way as the top rolling torque processing, calculates the acceleration of the bottom drive system from the bottom work roll rotational speed measurement value 11, calculates the contribution of the acceleration of the bottom roll system to the drive torque while considering the moment of inertia of the bottom roll system, and subtracts this from the bottom spindle torque measurement value 25 to estimate the net bottom rolling torque computed value 23.

In this way, the eighth aspect gives a drive torque control amount and controls the top drive electric motor 5 so that the rolling torque, obtained by subtracting from the top spindle torque measurement value 17 the inertial force of the roll system, matches the control target value. Further, it updates the control target value during rolling based on spindle torque measurement value of the work roll driven by the electric motor controlling the roll using the roll rotational speed as a control target value, so it is possible to maintain the balance of the rolling torques of the top and bottom work rolls even under rolling conditions of severe acceleration and deceleration.

Note that FIG. 8 shows an example where the top work roll 2 is controlled in drive torque and the bottom work roll 3 is controlled in roll rotational speed, but the top and bottom controls may also be switched.

Figure 9:
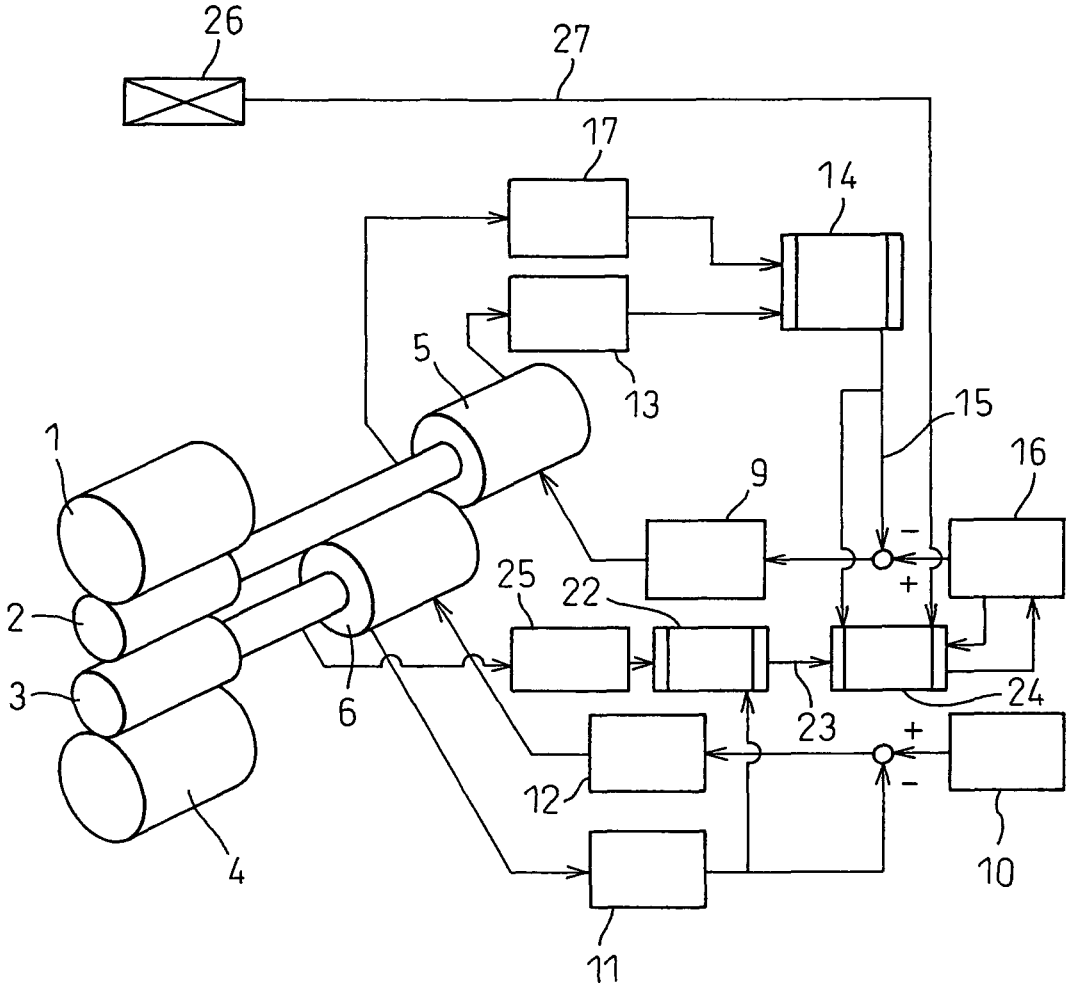
FIG. 9 is a view of the configuration showing a ninth aspect of a rolling mill for a plate or a sheet and its control technique according to the present invention.

FIG. 9 is a view of the configuration showing a ninth aspect of a rolling mill for a plate or a sheet and its control technique according to the present invention and is a view of the eighth aspect plus a rolling load measurement device 26.

In the eighth aspect, if the temperature of the rolled material varies in the longitudinal direction, short cycle deformation resistance fluctuations will occur, so the rolling torque of the bottom work roll 3 being controlled in roll rotational speed will also fluctuate in a short cycle corresponding to this.

Further, this fluctuation of the rolling torque has a good possibility of being removed as noise at the time of the time series smoothing performed by the top rolling torque target value processor 24, so in this case, the amount of fluctuation of the rolling torque is not reflected in the top rolling torque target value 16.

Further, the top rolling torque is controlled to match the top rolling torque target value 16 with a high response and high precision, so the balance of the rolling torques of the top and bottom work rolls is disturbed in a short cycle by only the fluctuation of the bottom rolling torque.

The ninth aspect shown in FIG. 9 maintains the balance of the rolling torques of the top and bottom work rolls even when there is such short cycle deformation resistance fluctuations by inputting the rolling load measurement value 27 output from a rolling load measurement device 26 provided at the rolling mill to the top rolling torque target value processor 24 and calculating and adding the amounts of fluctuation of the top rolling target value corresponding to the short cycle rolling load fluctuations.

Note that this processing of the amount of fluctuation of the top rolling torque target value may for example be multiplication of a torque arm coefficient obtained by set calculations with the amount of fluctuation of the rolling load.

In this embodiment, the rolling torque of the torque control side roll fluctuates, but this fluctuation is a combination of the fluctuations of the total top and bottom torques. The ratio of the rolling torque of the torque control side roll to the total top and bottom torque is kept substantially constant. Therefore, the basic configuration of controlling the rolling torque of the torque control side to be substantially constant remains unchanged.

Figure 10:
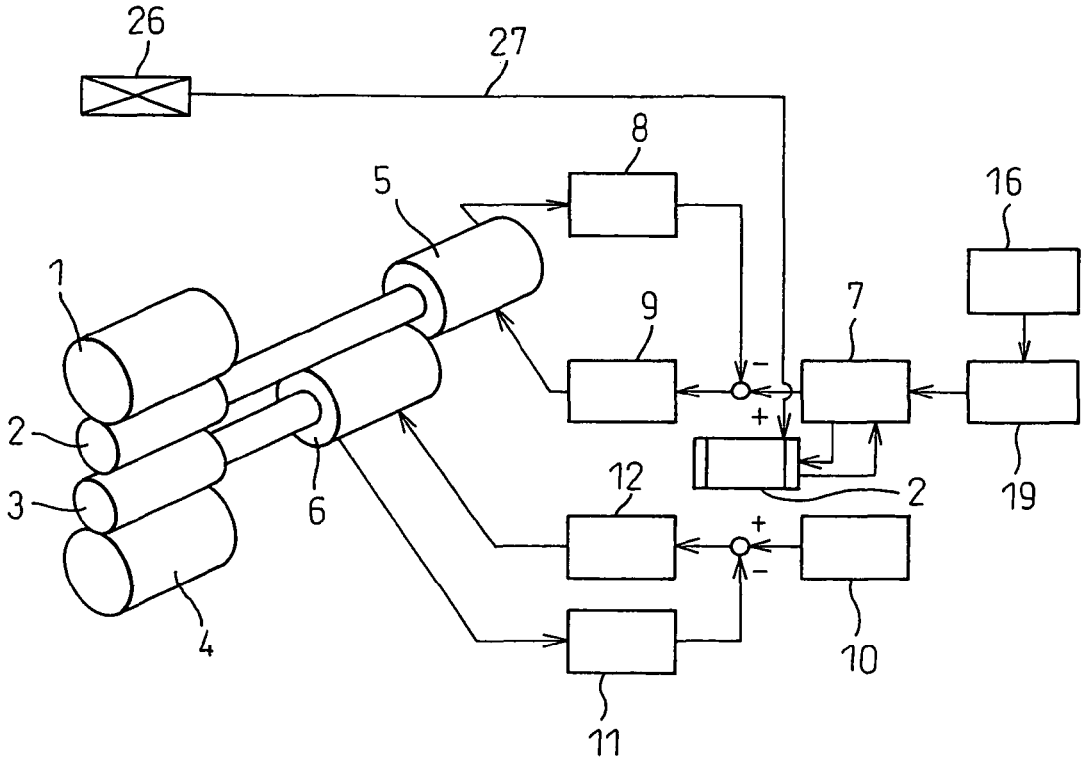
FIG. 10 is a view of the configuration showing a 10th aspect of a rolling mill for a plate or a sheet and its control technique according to the present invention.

FIG. 10 is a view of the configuration showing a 10th aspect of a rolling mill for a plate or a sheet and its control technique according to the present invention and shows the first aspect plus a rolling load measurement device 26 and a top drive torque target value processor 28.

This is also an aspect wherein, in the ninth aspect, the top rolling torque target value is replaced with the top drive torque target value and information regarding the torque fluctuations from the bottom roll side is not connected with the top drive torque target value processor 28. In this aspect as well, it is possible to estimate the total value of the top and bottom torque measurement values from the rolling load, so control based on ninth aspect is possible.

INDUSTRIAL APPLICABILITY

As explained above, according to the rolling mill for a plate or a sheet and its control technique according to the present invention, it is possible to suppress rapid changes in the balance of the rolling torques of the top and bottom work rolls and possible to eliminate running trouble due to warping of the rolled material or flatness defects due to wavy shapes running across the plate/sheet width direction called "waviness", "full waves", "small waves", etc. Due to this, stable rolling operation is achieved, not only the operating ratio, but also the yield rises, and the overall rolling productivity is improved needless to say.

DESCRIPTION OR REFERENCES

1 top reinforcing roll
2 top work roll
3 bottom work roll
4 bottom reinforcing roll
5 top drive electric motor
6 bottom drive electric motor
7 top drive torque target value
8 top drive torque measurement value
9 top drive torque control amount
10 bottom work roll rotational speed target value
11 bottom work roll rotational speed measurement value
12 bottom work roll rotational speed control amount
13 top work roll rotational speed measurement value
14 top rolling torque processor
15 top rolling torque compute value
16 top rolling torque target value
17 top spindle torque measurement value
18 bottom drive torque measurement value
19 top drive torque target value processor
20 sampling period
21 torque target value changing period
22 bottom rolling torque processor
23 bottom rolling torque computed value
24 top rolling torque target value processor
25 bottom spindle torque measurement value
26 rolling load measurement device
27 rolling load measurement value
28 top drive torque target value processor

The invention claimed is:

1. A rolling mill for rolling a plate or a sheet, the rolling mill comprising:

a top work roll and a bottom work roll;

an electric motor independently driving the top work roll and an electric motor independently driving the bottom work roll; and at least one controller, configured to control one electric motor to provide a roll rotational speed for one of the top and bottom rolls corresponding to a control target value, and to control the other electric motor driving the other of the top and bottom rolls to apply a substantially constant rolling torque to rolled material corresponding to a control target value using a drive torque as a control amount.

2. The rolling mill as set forth in claim 1, wherein the at least one controller is configured to control both electric motors to provide the roll rotational speed as a control target value before the rolled material is pulled into the mill and is further configured to switch control of one electric motor to control the drive torque as a control amount after the rolled material is pulled into the mill.

3. The rolling mill as set forth in claim 1, wherein the at least one controller is further configured to control one electric motor using the drive torque as a control amount until a tail end of the rolled material passes from the mill, and is further configured to control both electric motors using the roll rotational speed as a control target value as the tail end passes from the mill.

4. The rolling mill as set forth in claim 1, wherein the at least one controller is further configured to control one of the electric motors to provide a drive torque corresponding to the control amount, such that a rolling torque of a drive torque measurement value minus the torque due to the inertial force of the drive system and roll system corresponds to the control target value.

5. The rolling mill as set forth in claim 1, wherein the at least one controller is configured to control one of the electric motors to provide a drive torque control amount, such that a rolling torque of a spindle torque measurement value minus the torque due to the inertial force of the roll system corresponds to the control target value.

6. The rolling mill as set forth in claim 1, wherein the at least one controller is further configured to change a drive torque value of one of the electric motors to a control target value during rolling.

7. The rolling mill as set forth in claim 6, wherein the at least one controller is further configured to change the drive torque control target value linearly at a constant rate to a different control target value during rolling.

8. The rolling mill as set forth in claim 6, wherein the at least one controller is further configured to change the drive torque control target value during rolling through time-series smoothing based on a drive torque measurement value or a spindle torque measurement value of a work roll driven by the electric motor controlled using the roll rotational speed as a control target value.

9. The rolling mill as set forth in claim 6, wherein the at least one controller is further configured to change the drive torque control target value during rolling in accordance with fluctuations in rolling load.

10. A control technique for controlling a rolling mill for rolling a plate or a sheet, the rolling mill comprising top work roll and a bottom work roll, the technique comprising:

independently supplying drive power to each of the top and bottom work rolls with an independent electric motor;

controlling one independent electric motor to provide a roll rotational speed to one of the top and bottom work rolls corresponding to a control target value, and controlling the other independent electric motor driving the other of the top and bottom work rolls to apply a substantially constant rolling torque to rolled material corresponding to a control target using a drive torque as a control amount.

11. The control technique as set forth in claim 10, further comprising controlling both electric motors using the roll rotational speed as a control target value before the rolled material is pulled into the mill and switching control of one electric motor to control the drive torque as the control amount after the rolled material is pulled into the mill.

12. The control technique as set forth in claim 10, further comprising controlling one electric motor using the drive torque as a control amount until a tail end of the rolled material passes from the mill, and controlling the roll rotational speed as the control target value for both electric motors as the tail end passes from the mill.

13. The control technique as set forth in claim 10, further comprising controlling one of the electric motors to provide a rolling torque, such that a drive torque measurement value minus the torque due to the inertial force of the drive system and roll system corresponds to the control target value.

14. The control technique as set forth in claim 10, further comprising controlling one of the electric motors to provide a drive torque control amount, such that a rolling torque of a spindle torque measurement value minus the torque due to the inertial force of the roll system corresponds to the control target value.

15. The control technique as set forth in claim 10, further comprising changing a drive torque control target value of an electric motor controlling the drive torque during rolling.

16. The control technique as set forth in claim 15, further comprising changing the drive torque control target value linearly at a constant rate to a different control target value during rolling.

17. The control technique as set forth in claim 15, further comprising changing the drive torque control target value during rolling through time-series smoothing based on a drive torque measurement value or a spindle torque measurement value of a work roll driven by the electric motor controlled using the roll rotational speed as a control target value.

18. The control technique as set forth in claim 15, further comprising changing the drive torque control target value during rolling in accordance with fluctuations in the rolling load.

* * * * *

UNITED STATES PATENT AND TRADEMARK OFFICE

CERTIFICATE OF CORRECTION

PATENT NO. : 8,720,242 B2
APPLICATION NO. : 12/734439
DATED : May 13, 2014
INVENTOR(S) : Ogawa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 663 days.

Signed and Sealed this
Twenty-ninth Day of September, 2015

Michelle K. Lee

Michelle K. Lee
*Director of the United States Patent and Trademark Office*